US011302288B2

(12) United States Patent
Greenebaum et al.

(10) Patent No.: US 11,302,288 B2
(45) Date of Patent: Apr. 12, 2022

(54) AMBIENT SATURATION ADAPTATION

(71) Applicant: Apple Inc., Cupertino, CA (US)

(72) Inventors: Kenneth I. Greenebaum, San Carlos, CA (US); Denis V. Karch, Windsor (CA)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/584,348

(22) Filed: Sep. 26, 2019

(65) Prior Publication Data

US 2020/0105225 A1 Apr. 2, 2020

Related U.S. Application Data

(60) Provisional application No. 62/739,019, filed on Sep. 28, 2018.

(51) Int. Cl.
*G09G 5/10* (2006.01)
*G09G 5/02* (2006.01)

(52) U.S. Cl.
CPC ..... *G09G 5/10* (2013.01); *G09G 5/02* (2013.01); *G09G 2320/0242* (2013.01);
(Continued)

(58) Field of Classification Search
CPC ..... G09G 5/10; G09G 5/02; G09G 2360/144; G09G 2340/06; G09G 2320/0242;
(Continued)

(56) References Cited

U.S. PATENT DOCUMENTS 6,160,655 A 12/2000 Fix
6,987,519 B2 1/2006 Kumada
(Continued)

FOREIGN PATENT DOCUMENTS

WO 2016026072 A1 2/2016

OTHER PUBLICATIONS

Marcu, Gabriel, "Gamut Mapping in Munsell Constant Hue Sections", The Sixth Color Imaging Conference: Color Science, Systems, and Applications, pp. 159-162 (1998).
(Continued)

*Primary Examiner* — Mark W Regn
(74) *Attorney, Agent, or Firm* — Blank Rome LLP

(57) ABSTRACT

The disclosed techniques use a display device, in conjunction with various optical sensors, e.g., an ambient light sensor or image sensors, to collect information about the ambient lighting conditions in the environment of the display device. Use of this information—and information regarding characteristics of the display device—can provide a more accurate determination of unintended light being added to light driven by the display device. A processor in communication with the display device may evaluate a saturation model based, at least in part, on the received information about the ambient lighting conditions and display device characteristics to determine unintended light. The determined unintended light may prompt adjustments to light driven by the display device, such that the displayed colors remain relatively independent of the current ambient conditions. These adjustments may be made smoothly over time, such that they are imperceptible to the viewer.

20 Claims, 10 Drawing Sheets

(52) U.S. Cl.
CPC ..... *G09G 2320/0626* (2013.01); *G09G 2320/0666* (2013.01); *G09G 2320/0686* (2013.01); *G09G 2340/06* (2013.01); *G09G 2354/00* (2013.01); *G09G 2360/144* (2013.01)

(58) Field of Classification Search
CPC ..... G09G 2354/00; G09G 2320/0626; G09G 2320/0666; G09G 2320/0686; G09G 2360/16; G09G 3/2003; G09G 3/20
See application file for complete search history.

(56) References Cited

U.S. PATENT DOCUMENTS

| | | | | |
|---|---|---|---|---|
| 8,243,210 | B2 | 8/2012 | Bing | |
| 8,704,859 | B2 | 4/2014 | Greenebaum | |
| 8,954,263 | B2 | 2/2015 | Geelen | |
| 9,224,363 | B2 | 12/2015 | Ballestad | |
| 9,530,342 | B2 | 12/2016 | Bell | |
| 9,583,035 | B2 | 2/2017 | Buckley | |
| 10,007,977 | B2 | 6/2018 | Aaron | |
| 10,043,251 | B2 | 8/2018 | Huang | |
| 2002/0180751 | A1 | 12/2002 | Rozzi | |
| 2004/0008208 | A1 | 1/2004 | Dresevic | |
| 2005/0117186 | A1 | 6/2005 | Li | |
| 2006/0284895 | A1 | 12/2006 | Marcu | |
| 2007/0257930 | A1* | 11/2007 | Wade | G09G 3/2003 345/589 |
| 2008/0080047 | A1 | 4/2008 | Field | |
| 2008/0165292 | A1 | 7/2008 | Bing | |
| 2008/0303918 | A1 | 12/2008 | Keithley | |
| 2009/0141039 | A1 | 6/2009 | Ramanath | |
| 2010/0079426 | A1 | 4/2010 | Pance | |
| 2010/0124363 | A1 | 5/2010 | Ek | |
| 2010/0275266 | A1 | 10/2010 | Jakobson | |
| 2011/0074803 | A1 | 3/2011 | Kerofsky | |
| 2011/0141366 | A1 | 6/2011 | Yoon | |
| 2011/0285746 | A1 | 11/2011 | Swic | |
| 2011/0298817 | A1 | 12/2011 | Oshinome | |
| 2013/0071022 | A1 | 3/2013 | Jia | |
| 2013/0093783 | A1 | 4/2013 | Sullivan | |
| 2014/0082745 | A1 | 3/2014 | Guedalia | |
| 2014/0333660 | A1 | 11/2014 | Ballestad | |
| 2015/0002487 | A1* | 1/2015 | Miles | G06F 3/0362 345/184 |
| 2015/0070337 | A1 | 3/2015 | Bell | |
| 2015/0221250 | A1 | 8/2015 | Tada | |
| 2016/0110846 | A1 | 4/2016 | Park | |
| 2016/0125580 | A1* | 5/2016 | He | G09G 3/2003 345/590 |
| 2016/0240167 | A1* | 8/2016 | Breazile | G09G 3/3406 |
| 2016/0358346 | A1* | 12/2016 | Hendry | H04N 5/58 |
| 2016/0358584 | A1 | 12/2016 | Greenebaum | |
| 2017/0116963 | A1 | 4/2017 | Wanat | |
| 2017/0161882 | A1 | 6/2017 | Mantiuk | |
| 2018/0152686 | A1 | 5/2018 | Wozniak | |
| 2019/0384062 | A1 | 12/2019 | Wilson | |
| 2020/0105226 | A1 | 4/2020 | Greenebaum | |

OTHER PUBLICATIONS

Moroney, Nathan, et al., "The CIECAM02 Color Appearance Model", IS&T/SID Tenth Color Imaging Conference, pp. 23-27 (2002).

* cited by examiner

WHERE:

DESIRED RED VALUE A = LEAKAGE RED VALUE L + REFLECTANCE RED VALUE P + DRIVEN RED VALUE T = RESULTING RED VALUE A

DESIRED GREEN VALUE C = LEAKAGE GREEN VALUE M + REFLECTANCE GREEN VALUE Q + DRIVEN GREEN VALUE U = RESULTING GREEN VALUE C

DESIRED BLUE VALUE D = LEAKAGE BLUE VALUE N + REFLECTANCE BLUE VALUE S + DRIVEN BLUE VALUE V = RESULTING BLUE VALUE D

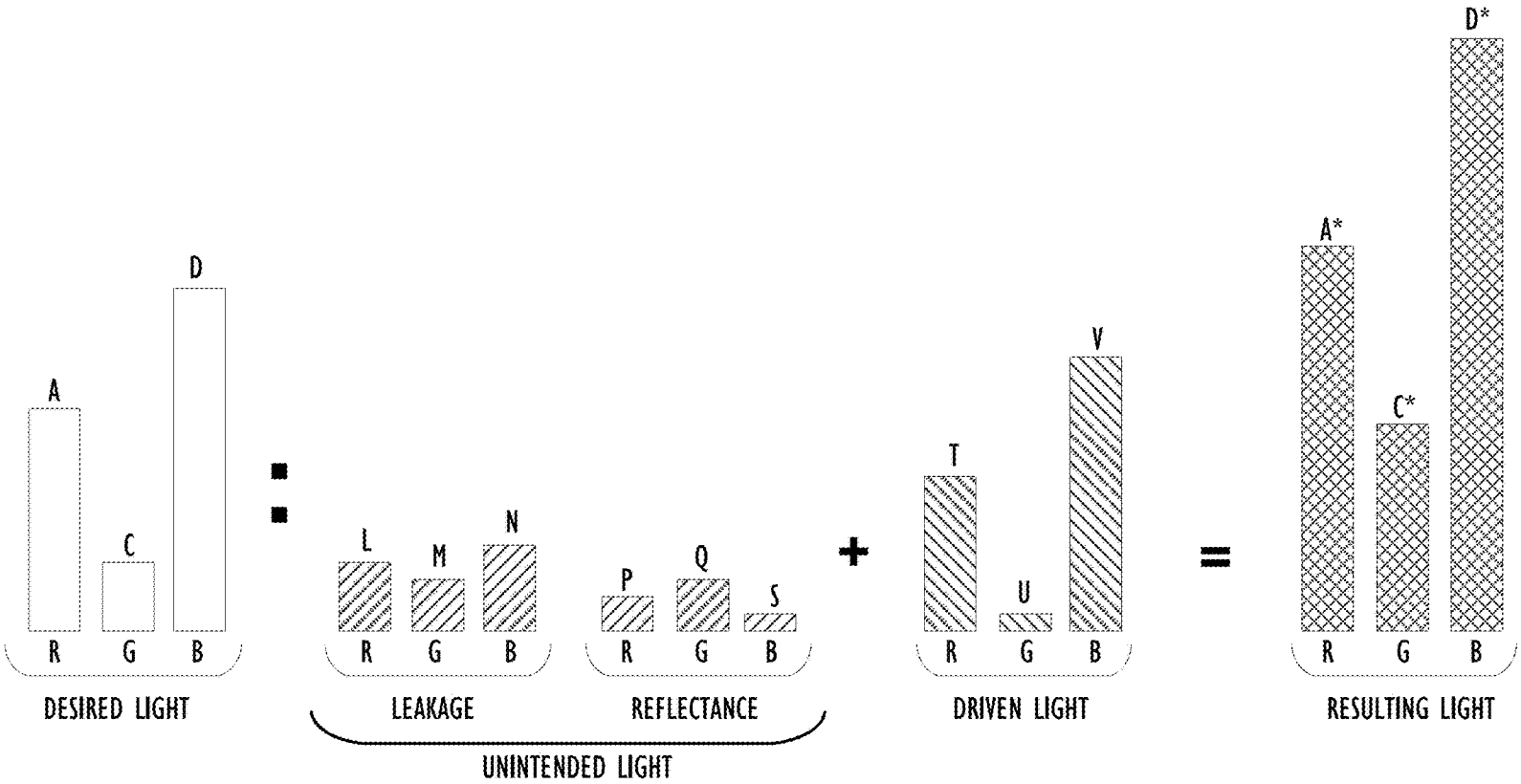

WHERE DESIRED GREEN VALUE C < LEAKAGE GREEN VALUE M + REFLECTANCE GREEN VALUE Q:

DESIRED RATIO A:C:D == RESULTING RATIO A*:C*:D*

LEAKAGE RED VALUE L + REFLECTANCE RED VALUE P + DRIVEN RED VALUE T = RESULTING RED VALUE A*
LEAKAGE GREEN VALUE M + REFLECTANCE GREEN VALUE Q + DRIVEN GREEN VALUE U = RESULTING GREEN VALUE C*
LEAKAGE BLUE VALUE N + REFLECTANCE BLUE VALUE S + DRIVEN BLUE VALUE V = RESULTING BLUE VALUE D*

*FIG. 7*

AMBIENT SATURATION ADAPTATION

BACKGROUND

Digital photography and videography has traditionally captured, rendered, and displayed content with relatively limited dynamic range and relatively limited gamut color spaces, such as the sRGB color space standardized by the International Electrotechnical Commission as IEC 61966-2-1:1999. Subsequent improvements have allowed content to be captured, rendered, and displayed with higher dynamic ranges and in larger gamut color spaces, such as the DCI-P3 color space, defined by Digital Cinema Initiatives and published by the Society of Motion Picture and Television Engineers in SMPTE EG 423-1 and SMPTE RP 431-2, and the even larger Rec. 2020 color space, defined by the International Telecommunication Union and published as ITU-R Recommendation BT.2020. Larger color spaces allow for a wider range of colors, especially saturated colors, as well as brighter colors, in content than was previously possible.

Today, many consumer electronic devices have display screens supporting high dynamic range, large gamut color spaces. As displays and their dynamic ranges and color spaces have improved, it has become increasingly necessary to color match content from its source color space to display color spaces. Color matching, such as the standard codified by the International Color Consortium (ICC), compensates for the divergence of gamut color spaces and characterizes and compensates for a display device's response. However, oftentimes, the characterization of the display device's response assumes ideal viewing conditions and ignores, for example, reflection off the display device, viewing angle dependencies, light leakage, screen covers (e.g., privacy screens), and the like. Without compensation for such non-ideal viewing conditions, the wide range of colors in content may be lost and/or distorted. Because light may generally be thought of as being additive in nature, the light that the user perceives is the sum of the light that is driven by, e.g., the display screen of a consumer electronic device, combined with unintended light such as light reflected off the display from ambient lighting conditions or light from flaws in the display screen itself, such as backlight leakage. This added light measurably changes the resulting light seen by a viewer of the display screen from the "rendering intent" of the author of the content, and may, in some cases, mask the full range and/or saturation of colors present in the content and enabled by large color spaces or the dynamic range of the display screen.

SUMMARY

As mentioned above, the resulting color produced by a display may vary from the intended color due to the addition of unintended light. For example, a display may commonly be in a standard office environment illuminated to 100 or more lux. The display reflects some portion of the ambient light in the environment, which combines with the display's driven light and changes the intended output. As another example, a display may commonly be viewed in the dark with minimal ambient light to reflect off the display. However, in this case, other flaws in the display device itself, such as backlight leakage, will combine with the driven light and change the resulting color. Often, the combination of ambient light from the environment and leakage from the display and backlight, unintended light, is a shade of white, which, in turn, desaturates the driven color as compared to the intended color. While some devices adjust the white point and black point of the display to account for ambient lighting conditions and device flaws, these changes do not necessarily restore the resulting color to its intended color. The resulting color remains measurably, and often perceptibly, different from the intended color due to additions of unintended light.

The techniques disclosed herein use a display device, in conjunction with information about the ambient conditions in the environment of a display device, to evaluate a saturation model, based at least in part on the received information about the ambient conditions and information about the display device. The saturation model may determine the effect of unintended light being added to light driven by the display device, which causes the sum of the driven light and the unintended light, the displayed light, to differ from the intended color. The output from the saturation model may then be used to adjust the light driven by the display device, such that the displayed color better approximates the intended color. Further the dynamically adjusted compensation allows the display device to be relatively impervious to the addition of unintended light from ambient conditions in which the display is being viewed or flaws in the display itself. The saturation models disclosed herein may solve, or at least aid in solving, various problems with current display technology, wherein, e.g., certain portions of displayed content change in hue or become incorrectly saturated due to backlight leakage or ambient light conditions.

BRIEF DESCRIPTION OF THE DRAWINGS

FIG. 7 illustrates another example comparison between desired color values, unintended light color values, driven pixel color values, and displayed color values to preserve a desired color ratio.

DETAILED DESCRIPTION

Figure 1A:
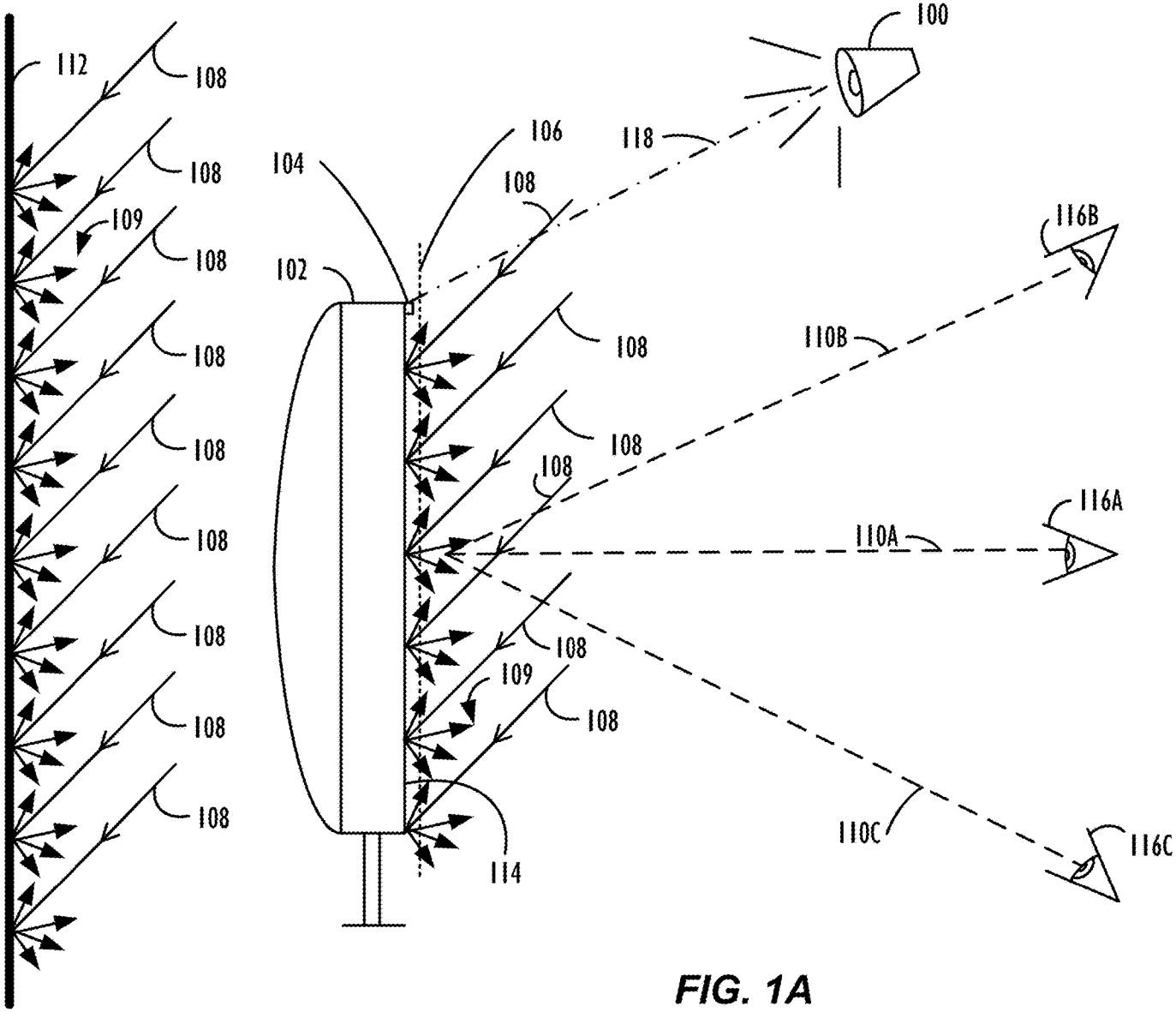
FIG. 1A illustrates the properties of ambient lighting and diffuse reflection off a display device.

The disclosed techniques use a display device, in conjunction with various optical sensors (e.g., ambient light sensors, image sensors, etc.), to collect information about the ambient conditions in the environment of the display device, such as ambient light sources, including direction, brightness, and color, the distance and viewing angle of a viewer to the display device, and the like. Such ambient condition information—and information regarding the display device, such as current brightness level, backlight leakage at current brightness level, color of backlight leakage, screen type, screen reflectivity, and the like—can provide a more accurate determination or calculation of unintended light being added to the light driven by the display device, and in turn, changing the displayed color from the intended color. A processor in communication with the display device may evaluate a saturation model based, at least in part, on the ambient conditions and information regarding the display device to calculate the unintended light being added to the light driven by the display device. The output of the saturation model may determine adjustments to light driven by the display device to display source content, such that the resulting color, perceived on screen and incorporating the unintended light, remains true to the rendering intent of the source content author. The saturation model may dynamically recalculate adjustments to be applied as content and unintended light changes over time, resulting in a display device that is relatively impervious to the addition of unintended light.

The techniques disclosed herein are applicable to any number of electronic devices: such as digital cameras; digital video cameras; mobile phones; personal data assistants (PDAs); head-mounted display (HMD) devices; digital and analog monitors such as liquid crystal displays (LCDs) and cathode ray tube (CRT) displays; televisions; desktop computers; laptop computers; tablet devices; billboards and stadium displays; automotive, nautical, aeronautic or similar instrument panels, gauges and displays; and the like. The techniques described herein are applicable to both emissive and subtractive displays. Subtractive displays include displays implementing conventional paints, dyes, or pigments, as well as e-inks, light filters, diffractors, light traps, and the subtractive cyan, magenta, and yellow color model.

In the interest of clarity, not all features of an actual implementation are described in this specification. It will of course be appreciated that in the development of any such actual implementation (as in any development project), numerous decisions must be made to achieve the developers' specific goals (e.g., compliance with system- and business-related constraints), and that these goals will vary from one implementation to another. It will be appreciated that such development effort might be complex and time-consuming, but would nevertheless be a routine undertaking for those of ordinary skill having the benefit of this disclosure. Moreover, the language used in this disclosure has been principally selected for readability and instructional purposes, and may not have been selected to delineate or circumscribe the inventive subject matter, with resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment. Similarly, "based on" includes "based, at least in part, on" and should not be understood as necessarily limiting the meaning to "based solely on."

Now discussion will turn to exemplary effects that unintended light from ambient lighting conditions and display device flaws may have on light driven by a display device. Referring now to FIG. 1A, the properties of ambient lighting and diffuse reflection off a display device are shown via the depiction of a side view of a viewer 116 of a display device 102 in a particular ambient lighting environment. As shown in FIG. 1A, viewer 116 is looking at display device 102. Viewer 116 may view display device 102 from different locations and viewing angles, as illustrated by viewer 116A, 116B, and 116C and dashed lines 110A, 110B, and 110C, which represent the viewing angle of viewer 116. The location, viewing angle, and distance of viewer 116 may influence perception of glare, backlight leakage, screen brightness, color uniformity, and other ambient conditions. For example, more efficient displays may appear worse at "off angles," such as the viewing angles of viewer 116B and 116C, than at a direct angle, such as that of viewer 116A, while less efficient displays may appear better than more efficient displays at the same off angles. In this example embodiment, display device 102 is a desktop computer monitor. In other embodiments, display device 102 may comprise, for example, a mobile phone, PDA, HMD, monitor, television, or a laptop, desktop, or tablet computer. In some embodiments, display device 102 may be used in conjunction with a privacy screen or other screen cover, which may further influence glare, backlight leakage, the amount of the driven light that reaches the viewers eyes, and the like.

The ambient environment as depicted in FIG. 1A is lit by environmental light source 100, which casts light rays 108 onto all the objects in the environment, including wall 112, as well as the display surface 114 of display device 102. As shown by the multitude of small arrows 109 (representing reflections of incoming light rays 108), a certain percentage of incoming light radiation will reflect back off of the surface that it shines upon. Although FIG. 1A shows only a single environmental light source 100, any number of environmental light sources may cast light onto the display surface 114 and cause reflections off it. One of the effects of reflection off display surface 114 is that, in instances where the intensity of the reflected light rays is greater than the intensity of light projected out from the display in a particular region of the display, the viewer will not be able to accurately perceive differences in tonality in those regions of this display. This effect is illustrated by dashed line 106 in FIG. 1A. Namely, light driven by display device 102 from the display surface 114 and unintended light, including light leaked from the display device 102 and ambient light reflected off the display surface 114, will add together. Thus, there may be a baseline brightness level (106) that emissive displays cannot be dimmer than (this level is also referred to herein as the "pedestal" of the display). Subtractive displays compensate by removing more light.

Figure 1B:
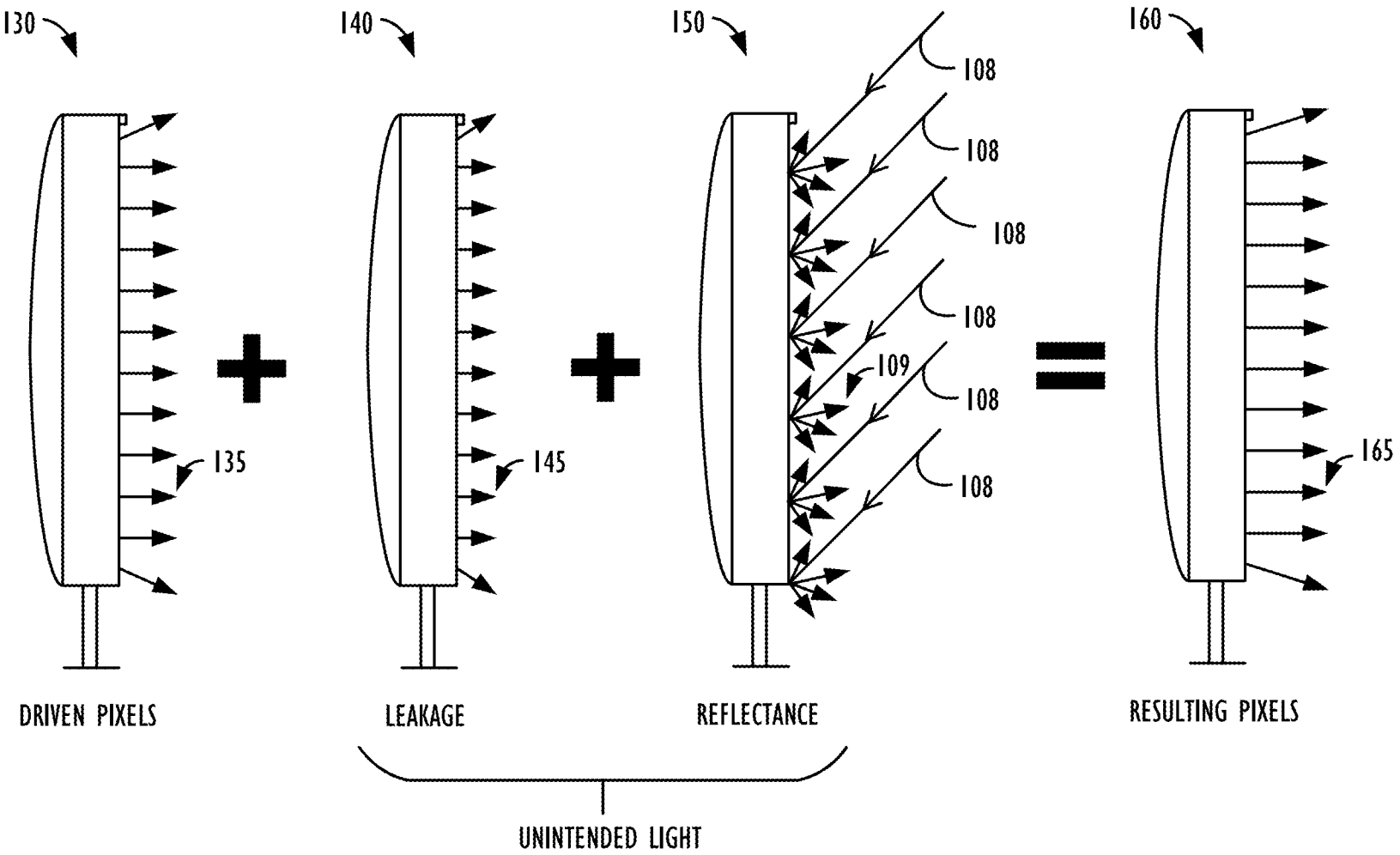
FIG. 1B illustrates the additive effects of unintended light on a display device.

No matter the relative intensities, the reflected light 109 is added to the light driven by display device 102, resulting in colors and light levels that are different from those intended by the source content author. FIG. 1B illustrates the additive effects of unintended light, including reflections, on a display device. For example, the light rays 135 emitting from display representation 130 represent the amount of light that the display intentionally drives the pixels to produce at a given moment in time. Likewise, light rays 145 emitting from display representation 140 represent the amount of light leakage from the display at the given moment in time, and light rays 109 reflecting off display representation 150 represent the aforementioned reflectance of incoming ambient light rays 108 off the surface of the display at the given moment in time. Light rays 145 and 109 are unintended light. In this example, the unintended light includes only leakage and reflectance, but other sources of unintended light, e.g., diffuse reflection, specular reflection, or changes in the viewer's perception of the unintended light due to privacy screens, off-angle viewing, and the like, are possible. Finally, display representation 160 represents the summation of the three forms of light illustrated in display representations 130, 140, and 150. As illustrated in FIG. 1B, the light rays 165 shown in display representation 160 represent the actual amount of light that will be perceived by a viewer of the display device at a given moment in time, which amount is, as explained above, different than the initial amount of light 135 the display was intentionally driven with, in order to produce the desired content at the given moment in time. Thus, measuring and accounting for the unintended light resulting from these various phenomenon may help to achieve a more consistent and content-accurate experience for a user viewing the display.

Returning to FIG. 1A, one or more optical sensors, e.g., ambient light sensor 104, may be used to collect information about the ambient conditions in the environment of the display device and may comprise, e.g., a color ambient light sensor, a monochromatic ambient light sensor, an image sensor, a video camera, or some combination thereof. Dashed line 118 represents data indicative of the light source being collected by ambient light sensor 104. A front-facing image sensor provides information regarding how much light, and in some embodiments, a brightness level and what color of light is hitting the display surface. This information may be used in conjunction with a model of the reflective and diffuse characteristics of the display to determine unintended light from reflections of light source 100 off display surface 114 and where the black point is for the particular lighting conditions that the display is currently in. For reference, "black point" may be defined as the lowest level of light to be used on the display in the current ambient environment (and at the viewer's current adaptation), such that the lowest images levels are distinguishable from each other (i.e., not "crushed" to black) in the presence of the current pedestal level (i.e., the sum of unintended light in the current environment of the display device and a model of the viewer's current visual adaptation to the display brightness, content brightness, and the ambient environment's brightness. The current pedestal level may be subtracted from driven pixel levels to adjust the resulting perceived light to correspond more closely to the source author's objective brightness intention. Emissive displays drive pixels at brightness values above the pedestal to ensure the pixels are not "crushed" to black and the viewer perceives the pixels according to the source author's intent. Subtractive displays are limited by their ability to capture light, such as using a black trap or a light shield.

A front facing image sensor may also be used to determine a location and viewing angle for viewer 116 relative to the display device, including a distance from the display device. This information may further be used to compute the individual viewing distance and angle to each pixel on the display and enable unique corrections for each pixel. Pixel-specific adjustments may be most beneficial in near field viewing, when the viewer is close the display.

Although ambient light sensor 104 is shown as a "front-facing" image sensor, i.e., facing in the general direction of the viewer 116 of the display device 102, other optical sensor types, placements, positioning, and quantities are possible. For example, one or more "back-facing" image sensors alone (or in conjunction with one or more front facing sensors) could give even further information about light sources and the color in the viewer's environment. The back-facing sensor picks up light re-reflected off objects behind the display and may be used to improve calculations of what the viewer sees beyond the display device, called the surround, and thus affords a better calculation of the viewer's visual adaptation. This information may also be used to adjust the gamut mapping of the display device. For example, the color of wall 112, if it is close enough behind display device 102, could have a profound effect on the viewer's white point adaptation. Likewise, in the example of an outdoor environment, the color of light surrounding the viewer affects saturation of colors displayed on the display device differently than it would in an indoor environment with neutral colored lighting.

In one embodiment, the ambient light sensor 104 may comprise a video camera capable of capturing spatial information, color information, as well as intensity information. Thus, utilizing a video camera could allow for the creation of a saturation model that could dynamically adapt not only the gamut mapping of the display device, but also the gamma, the black point, and the white point of the display device to compensate for "global" ambient lighting that influences all pixels in the display and for directed light that influences only select pixels and areas of the display. Compensation for "global" ambient lighting ensures the content is not "crushed" to black or "blown out" to white, while compensation for directed light enables the display to counter specular or complete reflections influencing only a few pixels in the display. For reference, "white point" may be defined as the color of light (e.g., as often described in terms of the CIE XYZ color space) that the user, given their current adaptation, sees as being a pure/neutral white color. This may be advantageous, e.g., due to the fact that a fixed system is not ideal when displays are viewed in environments of varying ambient lighting levels and conditions. In some embodiments, a video camera may be configured to capture images of the surrounding environment for analysis at some predetermined time interval, e.g., every two minutes, thus allowing the saturation model and light driven by the display to be continuously updated as unintended light and the ambient conditions in the viewer's environment change.

Additionally, a back-facing video camera intended to model the surroundings could be designed to have a field of view roughly consistent with the calculated or estimated field of view of the viewer of the display. Once the field of view of the viewer is calculated or estimated, e.g., based on the size or location of the viewer's facial features as recorded by a front-facing camera, assuming the native field of view of the back-facing camera is known and is larger than the field of view of the viewer, the system may then determine what portion of the back-facing camera image to use in the surround computation or implement an optical zoom to match the viewer's field of view.

In still other embodiments, one or more cameras, structured light systems, time-of-flight systems, light detection and ranging (lidar) systems, laser scanning systems, or other depth sensors may be used to further estimate the distance and angle of particular surfaces or the viewer from the display device. This information could, e.g., be used to further inform a saturation model of the likely composition of the surroundings and the impacts thereof on light driven by the display device. For example, a red wall that is 6 inches to the right of the display device may contribute more unintended light than a red wall that is 6 feet to the right of the display device.

Figure 2:
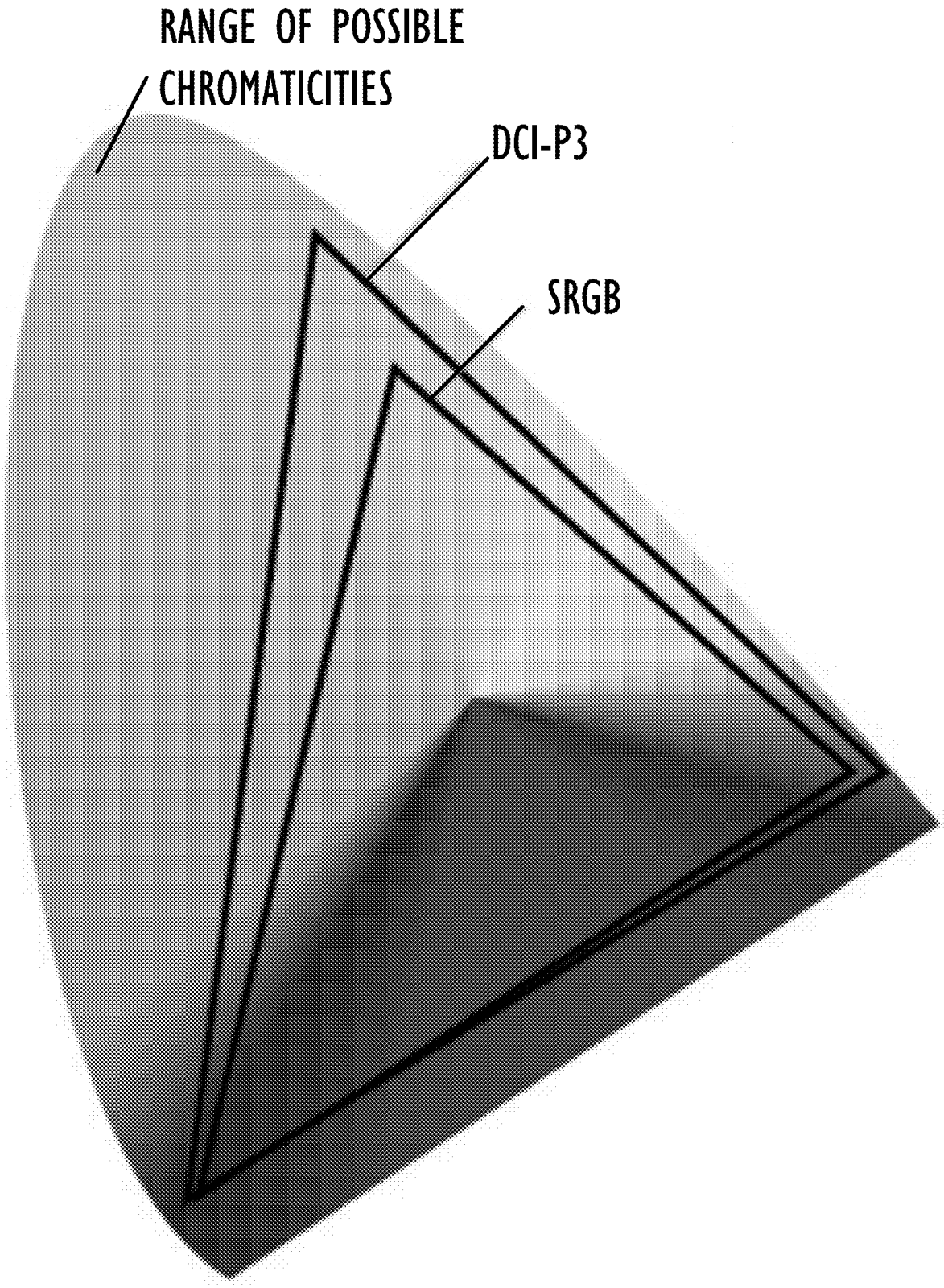
FIG. 2 illustrates a range of possible chromaticities and the subsets of that range represented by the DCI-P3 and sRGB color spaces.

FIG. 2 illustrates a range of chromaticities and the subsets of that range represented by the DCI-P3 and sRGB color spaces. As noted above, sRGB and DCI-P3 are standardized color spaces. A color space may be defined generically as a color model, i.e., an abstract mathematical model describing the way colors can be represented as tuples of numbers, that is mapped to a particular absolute color space. For example, RGB is a color model, whereas sRGB and DCI-P3 are particular color spaces based on the RGB color model. The particular color space utilized by a device may have a profound effect on the way color information created or displayed by the device is interpreted. For example, the DCI-P3 color space may be able to counter the effects of unintended light better than the sRGB color space, because it can leverage a wider color gamut.

In existing systems, a computer processor or other suitable programmable control device may adjust presentation of content based on the display device characteristics, such as the native luminance response, the color gamut, and the white point of the display device (which information may be stored in an International Color Consortium (ICC) profile), as well as the ICC profile the source content's author attached to the content to specify the rendering intent. The ICC profile is a set of data that characterizes a color input or output device, or a color space, according to standards promulgated by the ICC. ICC profiles may describe the color attributes of a particular device or viewing requirement by defining a mapping between the device color space and a profile connection space (PCS), usually the CIE XYZ color space. This mapping is called gamut mapping and tries to preserve, as closely as possible, the rendering intent of the content when presented on the display device. The mapping between the device color space and the profile connection space does not account for the addition of unintended light to light driven by the display device. Additional adjustments to the source color information may therefore be made, in order to compensate for the addition of unintended light.

Figure 3:
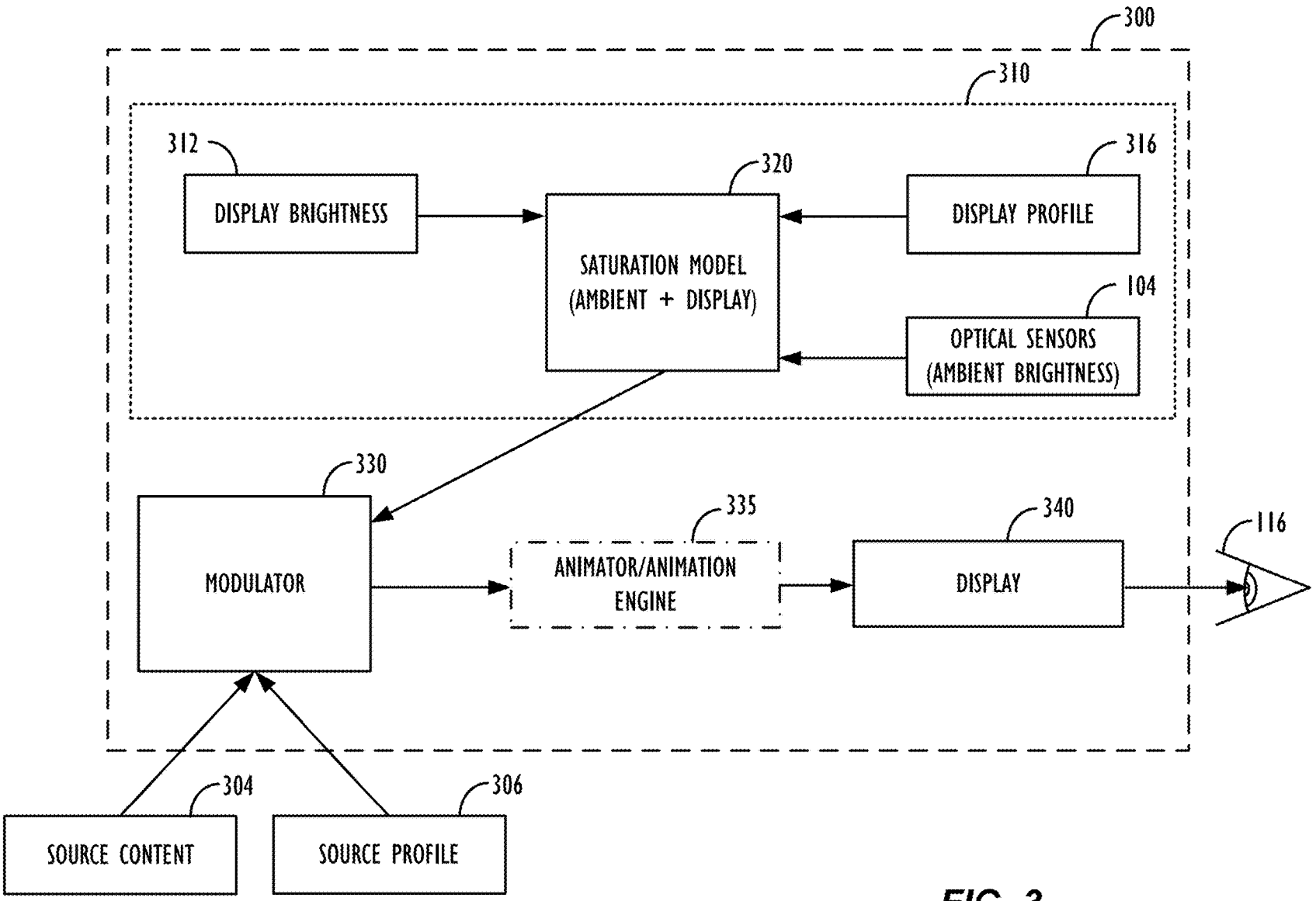
FIG. 3 illustrates a system for performing unintended light adjustments for a display device to compensate for unintended light, in accordance with one or more embodiments.

Referring now to FIG. 3, a system 300 for performing unintended light adjustments for a display device in response to the presence of unintended light is illustrated, in accordance with one or more embodiments. Source content 304 represents the source content, created by, e.g., a source content author, that viewer 116 wishes to view. Source content 304 may comprise an image, video, or other displayable content type. Source profile 306 represents the source profile, that is, information describing the color profile and display characteristics of the device on which source content 304 was authored. Source profile 306 may comprise, e.g., an ICC profile of the author's device or color space or other related information, and indicates the rendering intent of source content 304. Information relating to source content 304 and source profile 306 may be sent to viewer 116's device containing the system 300 for adaptation to display 340. Traditional systems perform a basic color management process on source content 304 before displaying it to viewer 116. However, modulator 330 may be used to dynamically compensate for unintended light. Dynamically compensating for unintended light may be based, e.g., on a calculation received from saturation model 320 about unintended light being added to light driven by display 340. This may mean adjusting the light driven by a small group of pixels of the display device to compensate for a localized effect from unintended light or adjusting the light driven by all pixels of the display to compensate for a more global effect from unintended light. Global changes may be used, for example, where viewer 116 is far away from display device 340, e.g., when viewer 116 is sitting on a couch watching a television set, including display device 340, mounted on a wall ten feet away. Localized changes may be used, for example, where viewer 116 is close to display device 340 or viewing it at an off-angle, e.g., when viewer 116 is tilting a tablet, including display device 340. Localized changes may also be used when glare is present on one particular portion of the screen, or when source content 304 is determined to need additional adjustment in regions of pixels having a particular color(s) or at a particular place(s) on the display screen, e.g., if source content 304 included a person wearing a red sweater standing against a white background, the pixels making up the red sweater portion of the displayed image may require a greater degree of ambient resaturation adjustment than, say, the pixels making up the white background portion of the displayed image. Adjusting the light driven by particular pixels may also mean that certain colors driven by the display are oversaturated compared to source content 304, e.g., in cases where saturation model 320 determines that unintended light is a white color and effectively desaturates light driven by display 340 compared to the rendering intent. In some embodiments, saturation model 320 provides continuous updates regarding unintended light and adjustments required to compensate for them. In this way, modulator 330 may continuously and dynamically adjust display 340 to compensate for changing unintended light, and modulate the adjustments, e.g., at a rate commensurate with a viewer's ability to perceive the adjustments, such that the adaptation appears seamlessly to the viewer. For example, where display 340 is viewed outdoors on a sunny day, modulator 330 may gradually adapt to changes in unintended light when a cloud passes over the sun, temporarily dimming ambient light of the display, in a manner that is not overtly noticeable to the user of the display device.

As illustrated within dashed line box 310, saturation model 320 may use various factors and sources of information in its calculation, e.g.: information indicative of ambient light conditions obtained from one or more optical sensors 104 (e.g., ambient light sensors); information indicative of the display profile 316's characteristics (e.g., an ICC profile, an amount of static backlight leakage for the display, a screen type and associated amount of screen reflectiveness, a recording of the display's 'first code different than black,' a characterization of the amount of pixel crosstalk across the various color channels of the display, etc.); and/or the display brightness 312. In some embodiments, saturation model 320 may also consider the location of the viewer relative to the display 340. Saturation model 320 may then evaluate such information to determine the unintended light being added to light driven by display 340 due to current ambient light conditions or display device flaws, and/or suggest adjustments to light driven from pixels in the display device to compensate for unintended light and to improve presentation of source content 304. As described previously, saturation model 320 may continuously update information used to determine the unintended light and recalculate the unintended light with the updated information.

According to some embodiments, the adjustments to light driven from pixels in the display device to compensate for unintended light may be implemented through shaders, modifications to one or more LUTs, such as three-dimensional LUTs, three distinct ID LUTs, and the like. In some embodiments, the unintended light adjustments may be implemented gradually (e.g., over a determined interval of time), via animation techniques such that the adjustments are imperceptible to the viewer. Modulator 330 may determine the unintended light adjustments in conjunction with saturation model 320 and animator/animation engine 335 may determine the rate at which such changes should be made to the display 340. In some embodiments, animator/animation engine 335 may adjust one or more LUTs based on the rate at which it predicts the viewer's vision will adapt to the changes. In this way, the changes in resulting light and color saturation may be imperceptible to the viewer. In still other embodiments, a threshold difference between the resulting color and the intended color may be employed, below which changes to the driven color need not be made. In some embodiments, the threshold difference between the resulting color and the intended color may be selected based on a prediction by saturation model 320 of the viewer 116's perception of color saturation under the ambient light conditions. When changes to the driven color and light are indeed necessary, according to some embodiments, animator/animation engine 335 may determine an appropriate duration over which such changes should be made and/or the 'step size' for the various changes. When a particular unintended light adjustment is not feasible, e.g., due to device limitations, modulator 330 or animator/animation engine 335 may instead implement a partial adjustment, selecting brightness, saturation, or another feature to optimize, in order to mimic the determined adjustment as closely as possible. For example, where the unintended light desaturates two adjacent colors, e.g., in the case of orange lettering on a red background, such that the cumulative driven and unintended light of the two adjacent intended colors are indistinguishable from one another (i.e., within the same MacAdam's ellipse) and the orange lettering is indistinguishable from the red background, the partial adjustment may optimize color contrast in order to recreate the intended color contrast including both colors, while, for example, allowing brightness or another parameter to vary from the source author's original intent.

As mentioned above, saturation model 320 may consider various sources, such as: information regarding ambient light conditions; information regarding display profile 316's characteristics; and/or the display brightness 312. Information regarding ambient light conditions may include the color and brightness of any ambient light sources, as well as the angle and distance from the ambient light source to the display device. For example, soft orange-white 2700K light from a 60 watt incandescent light bulb shielded by a lamp shade at a distance from the display device combines with light driven by the display device differently than bright white sunlight from a large window directly to one side of the display device. In some embodiments, optical sensors 104 may include a light field camera, which provides information indicative of light intensity and direction of light rays. This additional information regarding the direction of light rays may enable per-pixel adjustments to compensate for unintended light, specular reflections, and/or mirror-like reflections. In the absence of per-pixel adjustments, localized adjustments (such as local tone mapping, local color mapping, and/or color contrast correction) or global adjustments (such as increasing or decreasing the display device brightness) may be used to help correct for the consequences of the unintended light in the scene. In some embodiments, saturation model 320 may also receive information indicative of the location of viewer 116 relative to the display 340 from optical sensors 104. For example, the angle and distance from the viewer to the display device may influence the amount and location of glare perceived on the display device from an ambient light source. Information regarding display profile 316's characteristics may comprise information regarding display 340's color space, native display response characteristics or abnormalities, reflectiveness, backlight leakage, pedestal, or even the type of screen surface used by the display. For example, an "anti-glare" display with a diffuser will diffuse and re-reflect all ambient light, resulting in a larger pedestal than a glossy display experiences in a viewing environment in which the display, viewer, and ambient light sources are arranged to reduce the appearance of specular reflections. The comparatively larger pedestal for the "anti-glare" display with a diffuser causes more of the display's black levels to be indistinguishable at a given (non-zero) ambient light level than the glossy display. Information regarding the display brightness 312 may include display 340's current brightness level and/or brightness history, since how bright the display device is may influence the amount of backlight leakage from the display device. For example, saturation model 320 may incorporate a lookup table for backlight leakage based on current brightness level, scaled from backlight leakage at the maximum brightness level. The lookup table for backlight leakage may also consider changes to the display device pedestal in response to unintended light. In some embodiments, a color appearance model (CAM), such as the CIECAM02 color appearance model, may inform saturation model 320. Color appearance models may be used to perform chromatic adaptation transforms and/or for calculating mathematical correlates for the six technically defined dimensions of color appears: brightness (luminance), lightness, colorfulness, chroma, saturation, and hue.

As is to be understood, the exact manner in which saturation model 320 processes information received from the various sources 312/316/104, and how it determines unintended light being added to light driven by display 340 and determines adjustments to light driven by display 340 to compensate for the unintended light, including how quickly such adjustments take place, are up to the particular implementation and desired effects of a given system.

Figure 4:
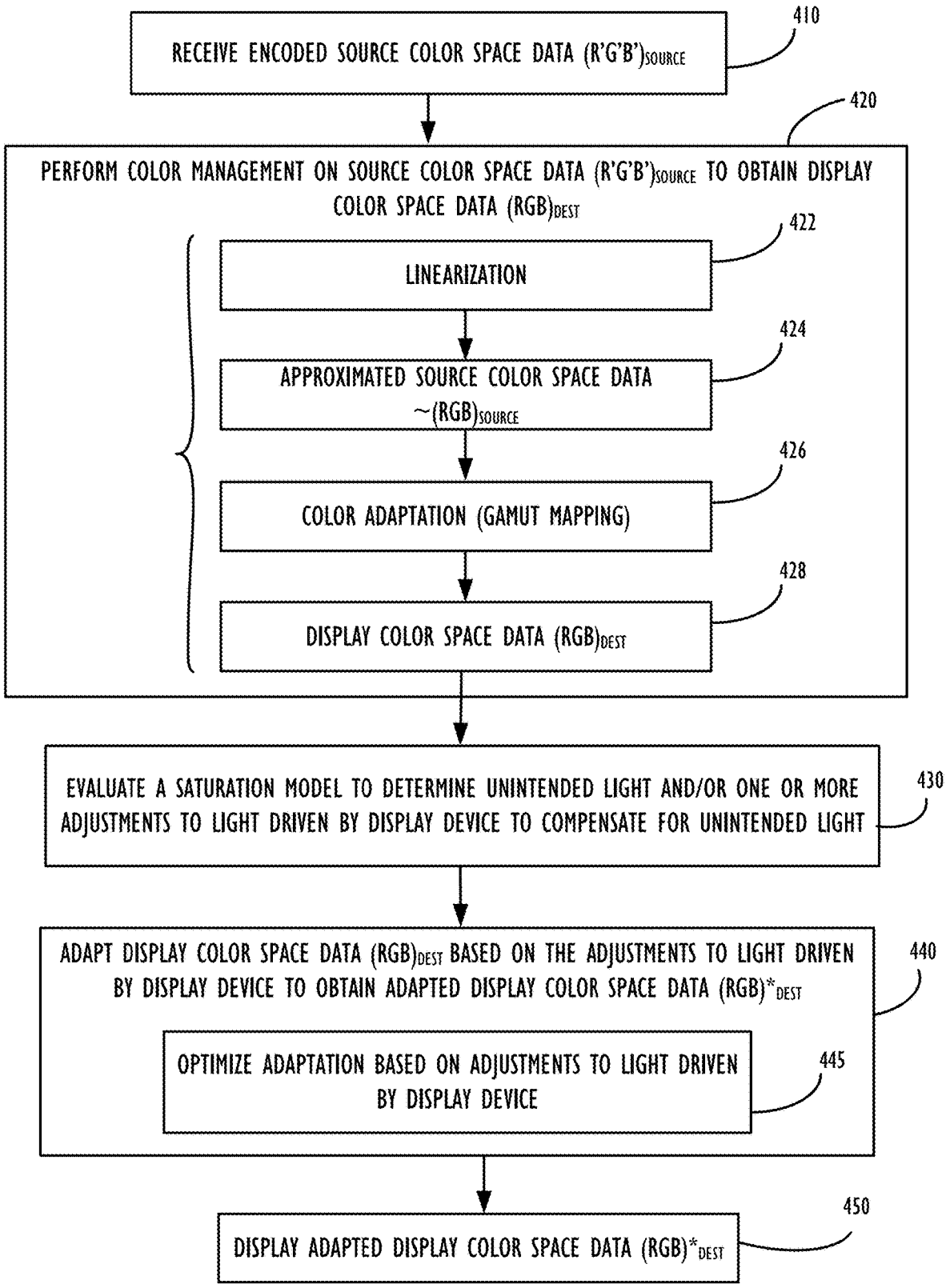
FIG. 4 illustrates, in flow chart form, a process for performing unintended light adjustments for a display device in response to the presence of unintended light, in accordance with one or more embodiments.

FIG. 4 illustrates, in flow chart form, a process for adjusting light driven from pixels in a display device to compensate for unintended light, in accordance with one or more embodiments. The overall goal of some saturation models may be to understand how the source material and intended colors will be displayed after the addition of unintended light from characteristics of the display device and from the ambient lighting conditions surrounding it. Turning now to the process 400 illustrated in FIG. 4, first, the display adjustment process may begin by receiving encoded source color space data $(R'G'B')_{SOURCE}$ (Step 410). The apostrophe after a given color channel, such as R', indicates that the information for that color channel is linearly encoded. The subscript "SOURCE" for color space data indicates that the color space data is presented according to the source color space. Next, the process may perform color management on source color space data $(R'G'B')_{SOURCE}$ to obtain decoded display color space data $(RGB)_{DEST}$ (Step 420). The subscript "DEST" for color space data indicates that the color space data is presented according to the destination display color space. Color management may include linearization of source color space data $(R'G'B')_{SOURCE}$ to remove gamma encoding (Step 422). For example, if the data has been encoded with a gamma of (1/2.2), the linearization process may attempt to linearize the data by performing a gamma expansion with a gamma of 2.2. The result of linearization, $(RGB)_{SOURCE}$, is a decoded approximation of source color space data $(R'G'B')_{SOURCE}$ (Step 424). At this point, the process may perform any number of gamut mapping techniques to convert the data $(RGB)_{SOURCE}$ from the source color space into the display color space (Step 426). In one embodiment, the gamut mapping may use color adaptation matrices. In other embodiments, a 3DLUT may be applied. The gamut mapping process results in the saturation model having intended color data in the display device's color space, as $(RGB)_{DEST}$ (Step 428).

At this point, the display adjustment process may evaluate a saturation model to determine unintended light present at the display device and one or more adjustments to light driven by the display device in accordance with the various methods described above (Step 430). For example, the saturation model may be evaluated based, at least in part, on received data indicative of characteristics of the display device and received data indicative of ambient light conditions surrounding the display device. Based on the saturation model's determination that, e.g., unintended light is a white color and effectively desaturates displayed colors compared to the rendering intent, light driven by the display device may be adjusted such that the resulting color corresponds to the rending intent. Then, display color space data $(RGB)_{DEST}$, the color in the display color space corresponding to source color space data $(R'G'B')_{SOURCE}$, is adapted based on the determined adjustments to the light driven by the display device to account for the addition of unintended light from current ambient light conditions or display device characteristics (i.e., as determined in Step 430), resulting in adapted display color space data $(RGB)^*_{DEST}$ (Step 440). The superscript "*" for color space data indicates the color space data includes adjustments according to the saturation model. In some embodiments, Step 440 may further include optional Step 445, e.g., in instances when the determined adjustments to the light levels driven by the display device resulting from the saturation model's determination of unintended light cannot physically be implemented by the display device. In such instances, Step 445 may be executed to adapt the display color space data $(RGB)_{DEST}$ in the most optimized fashion, in order to provide the viewer of the display device with as close to the intended viewing experience as possible, given the physical limitations of the display device. For example, where the unintended light alone exceeds the intended color, without any driven light, the optimization may result in an increase to the display device's overall brightness, such that, while the total light emitted by the display exceeds what was intended by the source content author, the relative ratios of the resulting light colors correspond to the source content author's rendering intent. Note that, while on emissive displays, it might not be possible to compensate to provide absolute brightness correction for the dimmest levels (which could be driven negative), it might not be desirable to provide absolutely corrected brightness levels matching the original intention since the leaked light may be from the environment, affecting the user's adaptation and thus causing the black level to increase which in turn may swallow all or most of the extra light level. Next, adapted display color space data $(RGB)^*_{DEST}$ is driven by the display device (Step 450). Under current ambient light conditions and display device characteristics, the adapted display color space data $(RGB)^*_{DEST}$ driven by the display device will be modified by the addition of unintended light, such that the resulting color corresponds to the rendering intent, source color space data $(R'G'B')_{SOURCE}$. As described previously, Steps 430 and 440 may be repeated one or more times, or looped continuously, as updated information regarding ambient conditions and the like become available. Using the updated information, the determination of unintended light may be recalculated and up-to-date adjustments to light driven by the display device may be determined to compensate for the updated determination of unintended light.

Figure 5:
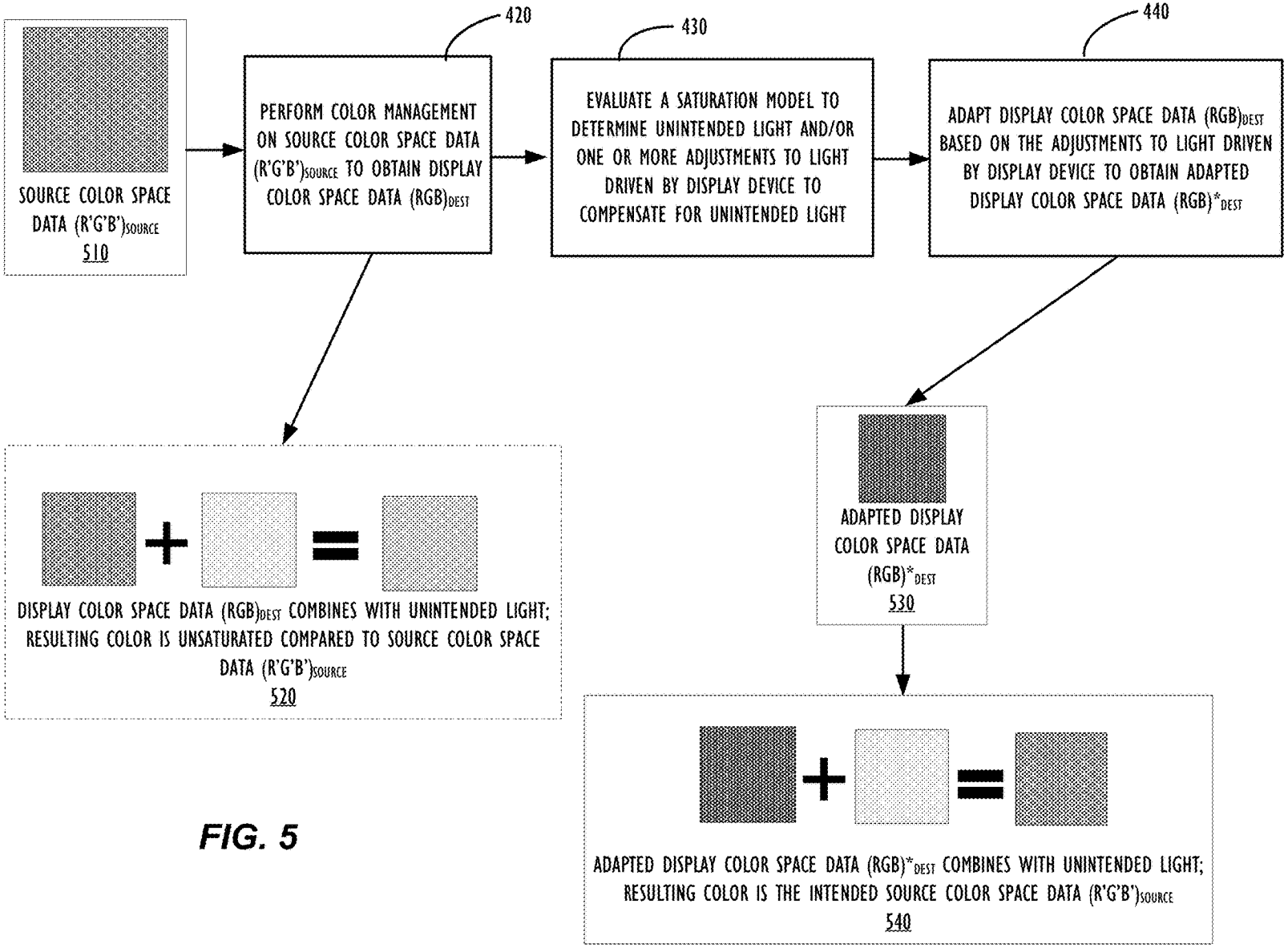
FIG. 5 illustrates, in system diagram form, a process for performing unintended light adjustments for a display device in response to the presence of unintended light, in accordance with one or more embodiments.

FIG. 5 illustrates, in system diagram form, a process for adjusting light driven from pixels in a display device to compensate for unintended light and adapting content based on the adjustments, in accordance with one or more embodiments. A pixel with source color space data $(R'G'B')_{SOURCE}$ 510 is input to the system. The apostrophe after a given color channel, such as R', indicates that the information for that color channel is linearly encoded. The subscript "SOURCE" for color space data indicates that the color space data is presented according to the source color space. Source color space data $(R'G'B')_{SOURCE}$ 510 may be encoded and include a source profile, such as source profile 306 described in reference to FIG. 3. Color management is performed on source color space data $(R'G'B')_{SOURCE}$ 510 to obtain display color space data $(RGB)_{DEST}$ for the pixel as described in Step 420 of FIG. 4. The subscript "DEST" for color space data indicates that the color space data is presented according to the destination display color space. As described previously, traditional content rendering systems perform a basic color management process similar to Step 420 and then drive the pixel. If the pixel is driven as display color space data $(RGB)_{DEST}$ after basic color management but without evaluation of a saturation model, adjustments to compensate for unintended light, and adaptation of the display color space data $(RGB)_{DEST}$, display color space data $(RGB)_{DEST}$ driven by the display device combines with unintended light from current ambient lighting conditions and display device characteristics, such that the resulting color differs measurably from the rendering intent of source color space data $(R'G'B')_{SOURCE}$ 510. For example, dashed line box 520 illustrates that under certain ambient lighting conditions and display device characteristics, a pixel driven by the display device as display color space data $(RGB)_{DEST}$ will combine with unintended light that is white, un-saturating the resulting displayed color compared to source color space data $(R'G'B')_{SOURCE}$ 510. The process described herein performs color management, but also performs additional processing on display color space data $(RGB)_{DEST}$ to account for the addition of unintended light to display color space data $(RGB)_{DEST}$. Specifically, a saturation model is evaluated and one or more adjustments to light driven by the display device are determined, e.g., as described in Step 430 of FIG. 4. Display color space data $(RGB)_{DEST}$ is then adapted based on the adjustments to light driven by the display device to obtain adapted color space data $(RGB)^*_{DEST}$ 530, e.g., as described in Step 440 of FIG. 4. The superscript "*" for color space data indicates the color space data includes adjustments according to the saturation model. The pixel is then driven as adapted color space data $(RGB)^*_{DEST}$ 530. As illustrated in 540, the saturation model may account for the ambient light conditions and display device characteristics of dashed line box 520 that resulted in the addition of unintended light and an unsaturated displayed color. Thus, a pixel driven as adapted color space data $(RGB)^*_{DEST}$ 530 is modified by the addition of unintended light, but results in a displayed color that aligns with the rendering intent, source color space data $(R'G'B')_{SOURCE}$ 510.

Figure 6:
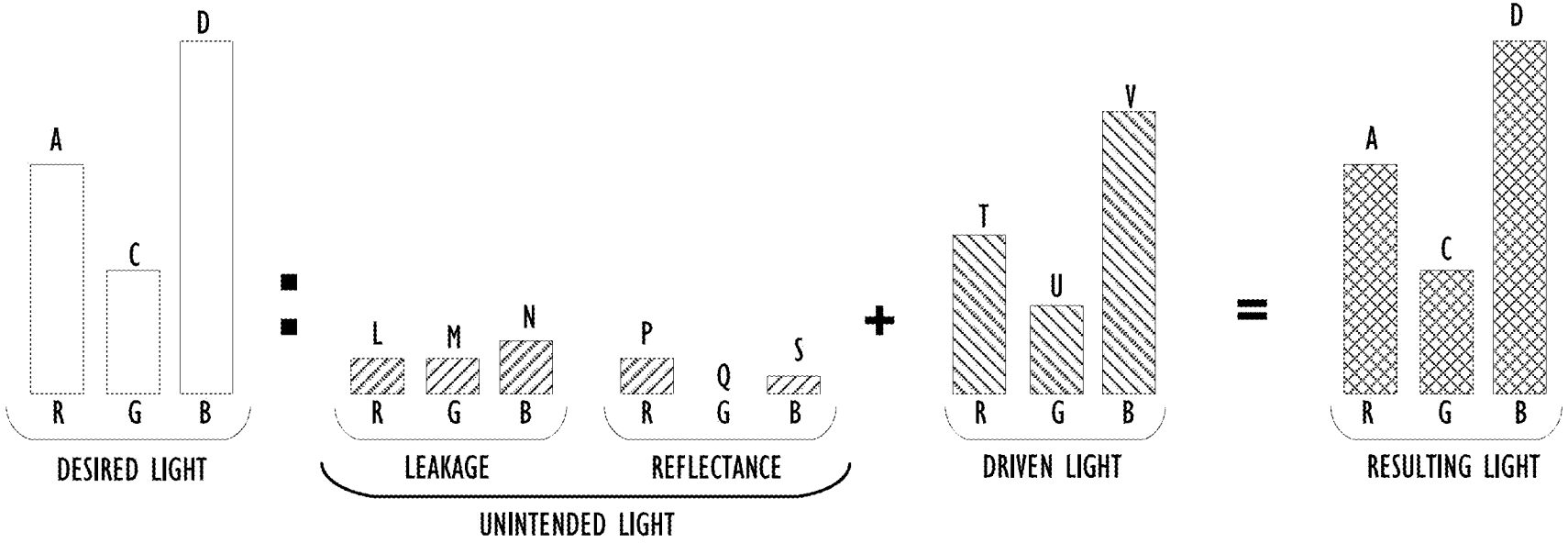
FIG. 6 illustrates an example comparison between desired color values, unintended light color values, driven pixel color values, and displayed color values.

FIG. 6 illustrates a comparison between the desired pixel color values, unintended light color values, driven pixel color values, and resulting pixel color values. In a further example, a pixel may have a color value of [A, C, D], wherein A indicates the red value, C indicates the green value, and D indicates the blue value, according to the RGB color model. While FIG. 6 uses the RGB color model to illustrate the effects of unintended light and compensation for unintended light, any color space may be used, such as the XYZ color space and the like. A saturation model, such as saturation model 320 described in reference to FIG. 3, determines that current ambient lighting conditions and display device characteristics result in the addition of leakage with a color value of [L, M, N], wherein L indicates the red value, M indicates the green value, and N indicates the blue value, according to the RGB color model and reflectance with a color value of [P, Q, S], wherein P indicates the red value, Q indicates the green value, and S indicates the blue value, according to the RGB color model. Using the determined unintended light, comprising of leakage light [L, M, N] and reflectance light [P, Q, S], the saturation model or a modulator, such as modulator 330 described in reference to FIG. 3, may determine one or more adjustments to the light driven by pixels of the display device. In this example, the pixel with color value [A, C, D] may be remapped to be driven with a modified color value [T, U, V], wherein T indicates the red value, U indicates the green value, and V indicates the blue value, according to the RGB color model. When the unintended light, e.g., a summation of [L, M, N] and [P, Q, S], is added to the modified driven color value [T, U, V], the resulting color value seen by the viewer may be represented as the intended [A, C, D]. As may be seen in FIG. 6, the desired Red value of A is achieved in the resulting pixel by the addition of L and P (i.e., the Red values of the unintended light) to T (i.e., the Red value of the light driven by the display). Similarly, the desired Green value of C is achieved in the resulting pixel by the addition of M and Q (i.e., the Green values of the unintended light) to U (i.e., the Green value of the light driven by the display). Further, the desired Blue value of D is achieved in the resulting pixel by the addition of N and S (i.e., the Blue values of the unintended light) to V (i.e., the Blue value of the light driven by the display). An animator/animation engine, such as animator/animation engine 335 described in reference to FIG. 3, may then implement the adjustments to the gamut mapping over time as appropriate.

FIG. 7 illustrates a further comparison between the desired pixel color values, unintended light color values, driven pixel color values, and resulting pixel color values to show adaptation of the adjustments to light driven by the display device in an optimized fashion, where the adjustments themselves are not physically possible (or at least not feasible), e.g., as described herein in Step 445. As in FIG. 6, a pixel has a desired color value of [A, C, D], according to the RGB color model. While FIG. 7 illustrates the effects of unintended light and compensation for unintended light using the RGB color model, any appropriate color model may be used, such as the XYZ color space and the like. A saturation model, such as saturation model 320 described in reference to FIG. 3, determines that current ambient lighting conditions and display device characteristics result in the addition of leakage with a color value of [L, M, N] and reflectance with a color value of [P, Q, S], according to the RGB color model. Using the determined unintended light, comprising of leakage light [L, M, N] and reflectance light [P, Q, S], the saturation model or a modulator, such as modulator 330 described in reference to FIG. 3, may determine one or more adjustments to the light driven by pixels of the display device. However, the Green values of the unintended light (i.e., leakage light Green value M and reflectance Green value Q) exceed the desired Green value of C, without any driven light, and the display device cannot produce "negative" light (i.e., cannot selectively "remove" light from the ambient area). Thus, for example, the display device brightness is increased and the light driven by the display device adjusted such that the pixel with color value [A, C, D] may be remapped to be driven with a modified color value [T, U, V], wherein T indicates the red value, U indicates the green value, and V indicates the blue value, according to the RGB color model. When the unintended light (i.e., a summation of leakage light [L, M, N] and reflectance [P, Q, S]) is added to the modified driven color value [T, U, V], the resulting color value is [A*, C*, D*]. While resulting color value [A*, C*, D*] does not directly equal the desired color value [A, C, D], the ratio of each color to each other are the same for resulting color value [A*, C*, D*] and desired color value [A, C, D]. The desired ratio of A:C:D is the same as the resulting ratio of A*:C*:D*.

As may be seen in FIG. 7, the resulting Red value of A* is achieved in the resulting pixel by the addition of L and P (i.e., the Red values of the unintended light) to T (i.e., the Red value of the light driven by the display). Similarly, the resulting Green value of C* is achieved in the resulting pixel by the addition of M and Q (i.e., the Green values of the unintended light) to U (i.e., the Green value of the light driven by the display). Further, the resulting Blue value of D* is achieved in the resulting pixel by the addition of N and S (i.e., the Blue values of the unintended light) to V (i.e., the Blue value of the light driven by the display). An animator/animation engine, such as animator/animation engine 335 described in reference to FIG. 3, may then implement the adjustments to the light driven by the display device over time as appropriate. As described previously, the adjustments to the light driven by the display device may be implemented in hardware, software, or any of a number of other solutions, such as through modification of one or more look-up tables and the like.

Figure 8:
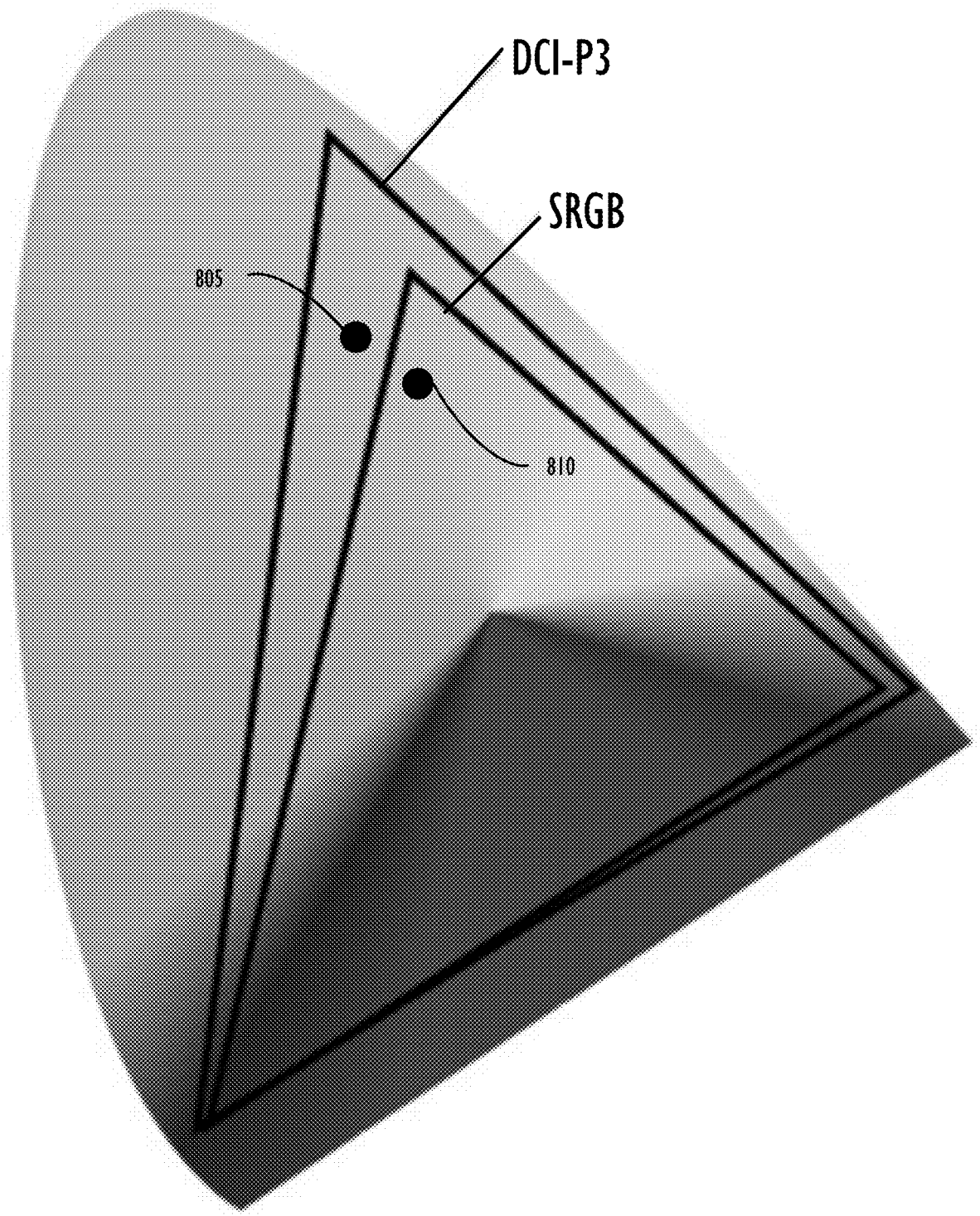
FIG. 8 uses gamut maps of a display color space and a source color space to illustrate an exemplary adjustment to light driven by a display device to compensate for the addition of unintended light, in accordance with one or more embodiments.

FIG. 8 illustrates an exemplary adjustment to light driven by a display device to compensate for unintended light, shown using a gamut mapping of a DCI-P3 enabled display device, in accordance with one or more embodiments. A range of colors perceivable by the human eye and the subsets of that range represented by the DCI-P3 and sRGB color spaces are shown, as described herein in reference to FIG. 2. In this example, the source color space data is represented by point 810 in the sRGB source color space. Under current ambient light conditions and display device characteristics, source color space data point 810 will combine with unintended light, resulting in a displayed color unsaturated compared to the intended color. In response, the light driven by the display device is adjusted to drive source color space data point 810 as the more saturated display color space data point 805. Note that display color space data point 805 is outside the bounds of the sRGB source color space, scaling the source color space into the display color space and thereby allowing the system to leverage the full gamut of the DCI-P3 display color space. As described in FIG. 5, the addition of unintended light to the oversaturated display color space data point 805 results in a displayed color of source color space data point 810. As also described above, in some embodiments, the adjustment to light driven by the display device may be implemented over a number of discrete steps to adjust the color previously represented by source color space data point 810 to its final representation by display color space data point 805 once the adjustment operation is completed.

The example described in FIG. 8 illustrates mapping a color point that exists in both the smaller sRGB source color space and the larger DCI-P3 display color space into a color point that only exists in the larger DCI-P3 display color space, thus leveraging the fuller range of the larger DCI-P3 display color space to achieve more accurate reproduction of the content. However, the principles described herein also apply to mapping between two of the same color spaces, e.g., sRGB to sRGB or DCI-P3 to DCI-P3, and between a larger color space to a smaller color space, e.g., DCI-P3 to sRGB, enabling differently and equally sized color spaces to be scaled appropriately to compensate for the influence of unintended light. The adjustments to light driven by the display device may influence the mapping of high dynamic range (HDR) content into a standard display, e.g., an 8-bit display, and the mapping of standard dynamic range (SDR) content into an HDR display, e.g., a 10-, or 12-bit display. Where the ideal adjustment to light driven by the display device would cause cut-off at the boundaries of the display color space, a "soft-clip" may be used to create a margin of deviation from the ideal adjustment in light driven by the display device to achieve a particular resulting color, leading to a smoother transition and avoiding harsh clipping.

Figure 9:
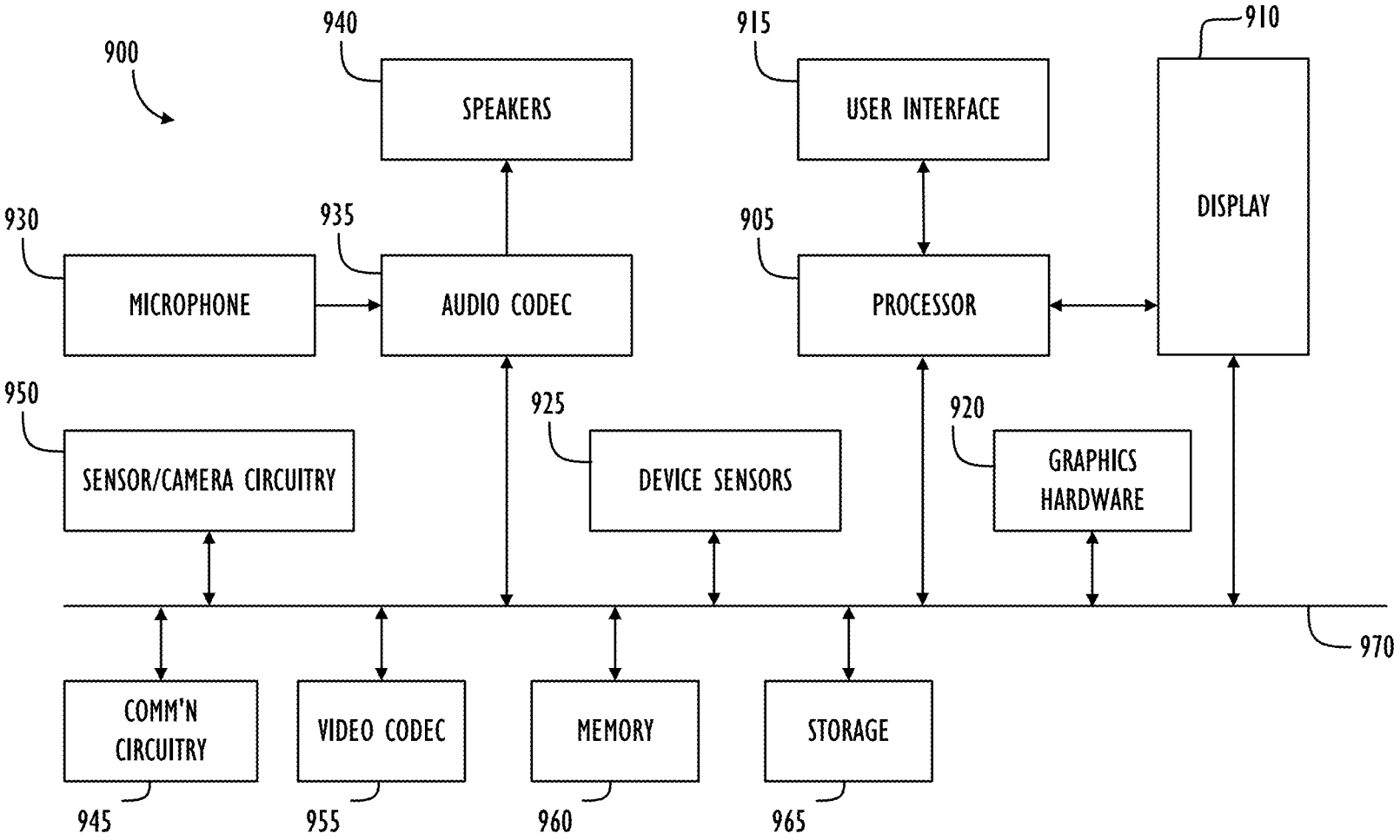
FIG. 9 illustrates a simplified functional block diagram of a device possessing a display, in accordance with one embodiment.

Referring now to FIG. 9, a block diagram of a representative electronic device possessing a display is shown, in accordance with some embodiments. Electronic device 900 could be, for example, a mobile telephone, personal media device, HMD, portable camera, or a tablet, notebook or desktop computer system. As shown, electronic device 900 may include processor 905, display 910, user interface 915, graphics hardware 920, device sensors 925 (e.g., proximity sensor/ambient light sensor, accelerometer and/or gyroscope), microphone 930, audio codec(s) 935, speaker(s) 940, communications circuitry 945, image sensor/camera circuitry 950, which may, e.g., comprise multiple camera units/optical sensors having different characteristics (as well as camera units that are housed outside of, but in electronic communication with, device 900), video codec(s) 955, memory 960, storage 965, and communications bus 970.

Processor 905 may execute instructions necessary to carry out or control the operation of many functions performed by device 900 (e.g., such as the generation and/or processing of signals in accordance with the various embodiments described herein). Processor 905 may, for instance, drive display 910 and receive user input from user interface 915. User interface 915 can take a variety of forms, such as a button, keypad, dial, a click wheel, keyboard, display screen and/or a touch screen. User interface 915 could, for example, be the conduit through which a user may view a captured image or video stream and/or indicate particular frame(s) that the user would like to have played/paused, etc., or have particular adjustments applied to (e.g., by clicking on a physical or virtual button at the moment the desired frame is being displayed on the device's display screen).

In one embodiment, display 910 may display a video stream as it is captured, while processor 905 and/or graphics hardware 920 evaluate a saturation model to determine unintended light and adjustments to light driven by the display device to compensate for the unintended light, optionally storing the video stream in memory 960 and/or storage 965. Processor 905 may be a system-on-chip such as those found in mobile devices and include one or more dedicated graphics processing units (GPUs). Processor 905 may be based on reduced instruction-set computer (RISC) or complex instruction-set computer (CISC) architectures or any other suitable architecture and may include one or more processing cores. Graphics hardware 920 may be special purpose computational hardware for processing graphics and/or assisting processor 905 perform computational tasks. In one embodiment, graphics hardware 920 may include one or more programmable graphics processing units (GPUs).

Image sensor/camera circuitry 950 may comprise one or more camera units configured to capture images, e.g., images which may be input to the saturation model and used to determine unintended light, e.g., in accordance with this disclosure. Output from image sensor/camera circuitry 950 may be processed, at least in part, by video codec(s) 955 and/or processor 905 and/or graphics hardware 920, and/or a dedicated image processing unit incorporated within circuitry 950. Images so captured may be stored in memory 960 and/or storage 965. Memory 960 may include one or more different types of media used by processor 905, graphics hardware 920, and image sensor/camera circuitry 950 to perform device functions. For example, memory 960 may include memory cache, read-only memory (ROM), and/or random access memory (RAM). Storage 965 may store media (e.g., audio, image and video files), computer program instructions or software, preference information, device profile information, and any other suitable data. Storage 965 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Memory 960 and storage 965 may be used to retain computer program instructions or code organized into one or more modules and written in any desired computer programming language. When executed by, for example, processor 905, such computer program code may implement one or more of the methods described herein.

The foregoing description of preferred and other embodiments is not intended to limit or restrict the scope or applicability of the inventive concepts conceived of by the Applicants.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A device, comprising:

a memory;

a display, wherein the display is characterized by a characteristic; and one or more processors operatively coupled to the memory, wherein the one or more processors are configured to execute instructions causing the one or more processors to:

receive data indicative of the characteristic of the display;

receive data indicative of ambient light conditions;

evaluate a saturation model based on:

the received data indicative of the characteristic of the display, and the received data indicative of ambient light conditions, and wherein the instructions to evaluate the saturation model further comprise instructions to:

(a) determine unintended light from the ambient light conditions and the characteristic of the display, and (b) determine an estimated effect of the unintended light;

determine one or more adjustments to light driven by the display based on the determination of unintended light, such that the estimated effect of the unintended light is reduced;

adapt a dataset to be displayed based on the one or more adjustments to light driven by the display; and display the adapted dataset on the display.

2. The device of claim 1, wherein the received data indicative of the characteristic of the display comprises at least one of: an ICC profile, a black point, a white point, a brightness level, a screen type, or a pedestal.

3. The device of claim 1, wherein the dataset to be displayed is authored in a source color space and wherein the source color space is different than a display color space associated with the display.

4. The device of claim 3, wherein the one or more adjustments to light driven by the display comprise scaling the source color space to the display color space.

5. The device of claim 1, wherein the one or more adjustments to light driven by the display comprise a localized adjustment to light driven by less than all pixels in the display.

6. The device of claim 5, wherein the localized adjustment is determined based on data indicative of a viewing angle of a viewer to the display and wherein the one or more processors are further configured to execute instructions causing the one or more processors to:

receive data indicative of the viewing angle of the viewer to the display, the instructions to evaluate the saturation model are further based on the received data indicative of the viewing angle of the viewer to the display.

7. The device of claim 1, wherein the one or more adjustments to light driven by the display comprise a global adjustment to light driven by all pixels in the display.

8. The device of claim 1, wherein the one or more processors are further configured to execute instructions causing the one or more processors to:

use an animation technique to implement the one or more adjustments to the light driven by the display over time.

9. The device of claim 1, wherein the instructions to evaluate the saturation model further comprise instructions causing the one or more processors to:

predict a viewer's perception of color saturation under the ambient light conditions.

10. A non-transitory program storage device comprising instructions stored thereon to cause one or more processors to:

receive data indicative of a characteristic of a display device;

receive data indicative of ambient light conditions;

receive a dataset to be displayed, wherein the dataset to be displayed is authored in a source color space;

evaluate a saturation model based on:

the received data indicative of the characteristic of the display device, and the received data indicative of ambient light conditions, and wherein the instructions to evaluate the saturation model further comprise instructions to:

(a) determine unintended light from the ambient light conditions and the characteristic of the display device, and (b) determine an estimated effect of the unintended light;

determine one or more adjustments to light driven by the display device based on the determination of unintended light, such that the estimated effect of the unintended light is reduced;

adapt the dataset to be displayed to a display color space associated with the display device based on a gamut mapping of the display device and the one or more adjustments to light driven by the display device; and display the adapted dataset on the display device.

11. The non-transitory program storage device of claim 10, wherein the source color space is different than the display color space.

12. The non-transitory program storage device of claim 11, wherein the one or more adjustments to light driven by the display device comprise scaling the source color space to the display color space.

13. The non-transitory program storage device of claim 10, wherein the one or more adjustments to light driven by the display device comprise a localized adjustment to light driven by less than all pixels in the display device.

14. The non-transitory program storage device of claim 13, wherein the localized adjustment is determined based on data indicative of a viewing angle of a viewer to the display device and wherein the non-transitory program storage device further comprises instructions to cause one or more processors to:

receive data indicative of the viewing angle of the viewer to the display device, wherein the instructions to evaluate the saturation model are further based on the received data indicative of the viewing angle of the viewer to the display device.

15. The non-transitory program storage device of claim 10, wherein the one or more adjustments to light driven by the display device comprise a global adjustment to light driven by all pixels in the display device.

16. The non-transitory program storage device of claim 10, wherein the received data indicative of the characteristic of the display device comprises at least one of: an ICC profile, a black point, a white point, a brightness level, a screen type, or a pedestal.

17. The non-transitory program storage device of claim 10, further comprising instructions to cause one or more processors to use an animation technique to implement the one or more adjustments to light driven by the display device over time.

18. A device, comprising:

a memory;

a display, wherein the display is characterized by a characteristic; and one or more processors operatively coupled to the memory, wherein the one or more processors are configured to execute instructions causing the one or more processors to:

receive data indicative of the characteristic of the display;

receive data indicative of ambient light conditions;

receive a dataset to be displayed, wherein the dataset to be displayed is authored in a source color space and comprises a first pixel with a first color value;

evaluate a saturation model, wherein the instructions to evaluate the saturation model further comprise instructions to:

determine unintended light from the ambient light conditions and the characteristic of the display device, determine an estimated effect of the unintended light, and determine a second color value for reducing the estimated effect of the unintended light, such that the determined unintended light combined with the second color value results in the first color value, and wherein the instructions to determine unintended light are based, at least in part, on:

the received data indicative of the characteristic of the display, and the received data indicative of ambient light conditions;

adapt the dataset to be displayed to a display color space associated with the display, wherein the instructions to adapt the dataset further comprise instructions to remap the first pixel with the first color value to have the second color value; and display the adapted dataset on the display.

19. The device of claim 18, wherein the second color value is greater than the first color value.

20. The device of claim 18, wherein the source color space is smaller than the display color space, and wherein the second color value is within the display color space but outside the source color space.

* * * * *